US005797545A

United States Patent [19]

Asinovsky

[11] Patent Number: 5,797,545

[45] Date of Patent: Aug. 25, 1998

[54] SELF-RIGHTING RISING SPRINKLER HEAD

[76] Inventor: Vladimir A. Asinovsky, 12322 Ella Lee La., Houston, Tex. 77077

[21] Appl. No.: 661,646

[22] Filed: Jun. 11, 1996

[51] Int. Cl.[6] ..... B05B 15/06

[52] U.S. Cl. ..... 239/279; 239/229; 239/273

[58] Field of Search ..... 239/229, 273, 239/279, 67, 68, 587.1, 588

[56] References Cited

U.S. PATENT DOCUMENTS

| | | | |
|---|---|---|---|
| 961,906 | 6/1910 | Smith . | |
| 2,290,258 | 7/1942 | Svet | 299/132 |
| 2,611,645 | 9/1952 | Forman | 299/69 |
| 2,954,932 | 10/1960 | Albano | 239/229 |
| 2,999,644 | 9/1961 | Nobinger | 239/229 |
| 3,079,727 | 3/1963 | Melin | 46/41 |
| 3,315,692 | 4/1967 | Arneson | 239/229 |
| 3,700,172 | 10/1972 | Gallegos, Sr. | 239/188 |
| 3,778,927 | 12/1973 | Edden | 46/233 |
| 3,921,911 | 11/1975 | Sheets | 239/206 |
| 4,204,643 | 5/1980 | Cornelius | 239/212 |
| 4,684,066 | 8/1987 | Uzrad | 239/229 |
| 4,747,540 | 5/1988 | Meyer | 239/76 |
| 4,753,394 | 6/1988 | Goodman | 239/542 |
| 4,836,291 | 6/1989 | Owens et al. | 169/46 |
| 5,022,588 | 6/1991 | Haase | 239/211 |
| 5,143,107 | 9/1992 | Kelley | 135/16 |
| 5,224,652 | 7/1993 | Kessler | 239/211 |
| 5,480,336 | 1/1996 | Blanchard | 446/89 |

*Primary Examiner*—J. Casimer Jacyna
*Attorney, Agent, or Firm*—Joseph N. Breaux

[57] ABSTRACT

A self-righting rising sprinkler head comprising a sprinkler head housing that defines a buoyant body chamber therein; and at least one buoyant body disposed within the buoyant body chamber. The sprinkler head housing also includes a plurality of water discharge ports, each providing a fluid passageway between the buoyant body chamber and the exterior of the sprinkler head housing, and a connecting fitting adapted for securing the sprinkler head to a source of pressurized water in a manner to supply the buoyant body chamber with pressurized water.

3 Claims, 2 Drawing Sheets

SELF-RIGHTING RISING SPRINKLER HEAD

TECHNICAL FIELD

The present invention relates to sprinkler heads and more particularly to a sprinkler head that is lifted above the ground through jet propulsion forces generated from water discharging from the sprinkler head and that has a self-righting capability.

BACKGROUND ART

Rising sprinkler heads are typically used in sprinkler system applications. Conventional sprinkler heads generally include a telescoping conduit assembly secured between the sprinkler discharge assembly and a source of pressurized water. Back pressure generated by the introduction of pressurized water causes the telescoping conduit assembly to extend, lifting the sprinkler head above its stored position. The sprinkler head then operates in a conventional manner sprinkling water over the vegetation in a regulated pattern.

Although the sprinkler systems using self rising sprinkler heads are interesting to watch when first activated, the regularity of their watering pattern can become monotonous to watch. It would be a benefit, therefore, to have a self-righting rising sprinkler head that would provide an interesting and entertaining display while in operation. In addition, conventional rising sprinkler heads typically rise only a few inches and do not rise to a sufficient height to adequately water over the tops of bushes and shrubs. Also, the high pressure and substantially horizontal discharge from conventional type sprinklers can cause damage to the leaves and flowers of shrubs and bushes directly in the path of the discharge and uneven water distribution because of these obstructions. It would be a benefit, therefore, to have a sprinkler head that could rise above the tops of shrubs and bushes that could provide a more natural water discharge pattern down over the leaves of the shrubs and bushes in the fashion of a rain shower.

GENERAL SUMMARY DISCUSSION OF INVENTION

It is thus an object of the invention to provide a self-righting rising sprinkler head that has a plurality of water discharge ports and that utilizes the force of water jets discharged through the water discharge ports as a force for lifting and maintaining the sprinkler head above the vegetation surface.

It is a still further object of the invention to provide a self-righting rising sprinkler head that includes a mechanism for regulating the discharge of water through the plurality of water discharge ports in a manner aimed to maintain the sprinkler head in a lifting orientation.

It is a still further object to provide a self-righting sprinkler head that can rise above the tops of shrubs and bushes and provide a natural water discharge pattern down over the leaves of the shrubs and bushes in the fashion of a rain shower.

It is a still further object of the invention to provide a self-righting sprinkler head that accomplishes all or some of the above objects in combination.

Accordingly, a self-righting rising sprinkler head is provided. The sprinkler head comprises a sprinkler head housing that defines a buoyant body chamber therein; and at least one buoyant body disposed within the buoyant body chamber. The sprinkler head housing also includes a plurality of water discharge ports, each providing a fluid passageway between the buoyant body chamber and the exterior of the sprinkler head housing, and a connecting fitting adapted for securing the sprinkler head to a source of pressurized water, for example by a hose, in a manner aimed to supply the buoyant body chamber with pressurized water. The water discharge ports are oriented in a manner such that the sum of the forces created by water discharging from the water discharge ports creates a lifting force acting against the sprinkler head in a manner such that restricting the discharge of water through some of the water discharge ports changes the direction of the sum of the forces. The buoyant body is sufficiently large to prevent its passage through any one of the plurality of water discharge ports. The buoyancy of the buoyant body is sufficient to cause the buoyant body to float in an upward direction when the buoyant body chamber is filled with pressurized water. The terms "upward", "upwardly" and "upward direction" are used herein to mean in a direction opposite the direction of the force of gravity.

When a source of pressurized water is connected to the sprinkler head, pressurized water fills the buoyant body chamber causing the buoyant body to float upwardly toward the top of the buoyant body chamber. As pressurized water discharges through the plurality of water discharge ports, the discharging water creates the lifting force against the sprinkler head causing it to move in the direction opposite the discharge. As the sprinkler head and buoyant body chamber therein change orientation with respect to an upward line, the buoyant body moves into the higher regions within the buoyant body chamber restricting fluid flow through that region and lessening the discharge forces generated from the water discharge ports located in the area of the higher region. The sum of the forces from the lower region then become greater than the sum from the higher region and the total sum of the forces from the water discharge ports are in a direction tending to bring the sprinkler head back into proper operating orientation with respect to the upward line. The term "proper operating orientation" is used herein to mean an orientation in which the total sum of the discharge forces acts to maintain the sprinkler head above the vegetation surface.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
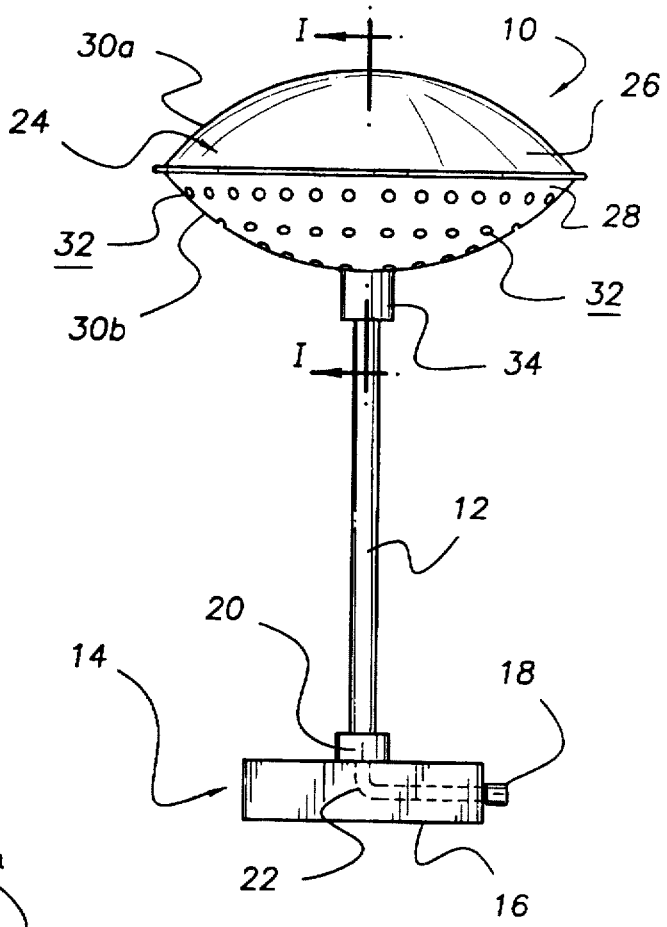
FIG. 1 is a side view of an exemplary embodiment of the self-righting sprinkler head of the present invention showing the sprinkler head housing including an upper sprinkler head housing member, a lower sprinkler head housing member that has a number of water discharge ports spaced symmetrically about the longitudinal axis thereof, and a hose receiving fitting in connection with a flexible hose; and a weighted base assembly including a conventional female hose connection.

FIG. 1 shows an exemplary embodiment of the self-righting sprinkler head of the present invention, generally designated by the numeral 10, in connection with a flexible hose member 12, and an exemplary weighted base assembly, generally designated by the numeral 14. Weighted base assembly 14 includes a cylindrical shaped, weighted base housing 16, a conventional female garden hose connector 18, and a hose fitting 20 adhesively secured to a first end of flexible hose member 12. Hose fitting 20 and conventional female garden hose connector 18 are connected by a fluid passageway 22 formed through base housing 16. Flexible hose 12 is a six foot length of conventional flexible light-weight tubing.

Figure 2:
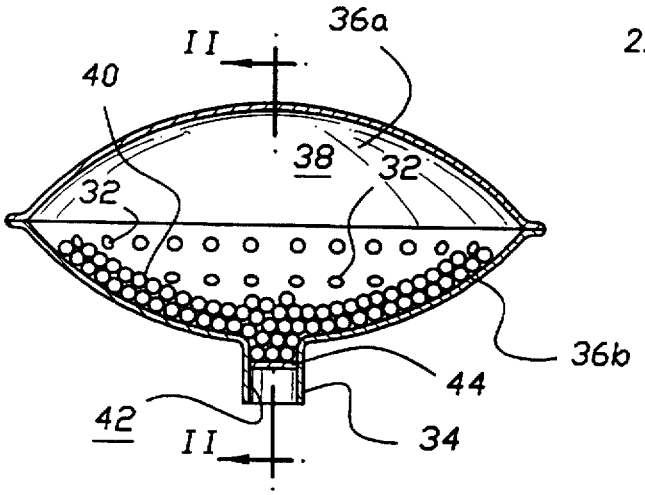
FIG. 2 is a cross sectional view through the longitudinal axis of the sprinkler head of FIG. 1 along the line I—I showing a screen member disposed within the hose receiving fitting, a buoyant body chamber formed within the sprinkler head housing, and a quantity of buoyant bodies entrapped within the buoyant body chamber.
Figure 2A:
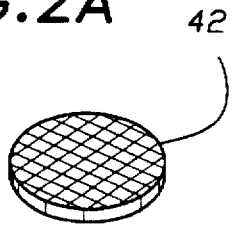
FIG. 2A is a perspective view of the screen member in isolation.
Figure 3:
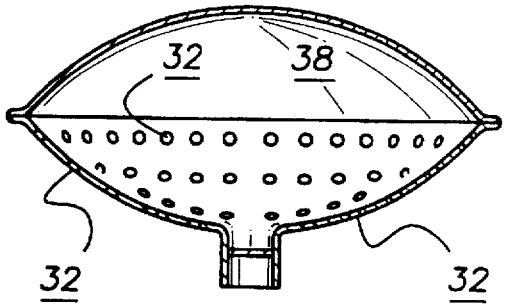
FIG. 3 is a cross sectional view of the sprinkler head of FIG. 2 along the line II—II with the buoyant bodies removed to reveal the symmetrically spaced water discharge ports.
Figure 4:
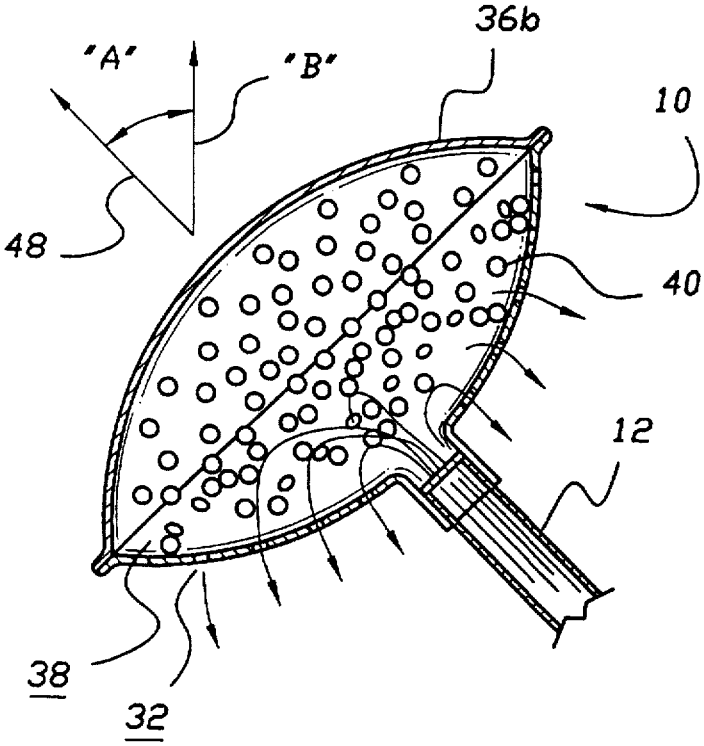
FIG. 4 is a cross sectional view of the sprinkler head of FIG. 1 with the longitudinal axis oriented at an angle "A" with respect to an upwardly oriented reference line "B" showing the movement of the buoyant bodies into a blocking position causing the sprinkler head to right itself.

Self-righting rising sprinkler head 10 includes a sprinkler head housing, generally designated by the numeral 24, having an upper housing member 26 and a lower housing member 28. Upper and lower housing members 26,28 are elliptical shaped plastic disks having outer surfaces 30*a*,30*b* that are curved with respect to the center of sprinkler head housing 24 and substantially identical in shape. Upper and lower housing members 26,28 are adhesively secured together with the perimeters thereof in registration. Lower housing member 28 has a plurality of spaced water discharge ports 32 arranged in four concentric rings about an integrally formed hose fitting 34 that extends outward from the center of lower housing member 28. Although upper and lower housing members 26,28 are adhesively secured, they may be integrally formed or secured in various other manners commonly used in the art to secure to members together. With reference to FIG. 2, upper and lower housing members 26,28 each has a curved inner surface 36*a*,36*b* that in combination define a buoyant body chamber 38. Buoyant body chamber 38 is filled to about five percent of its volume with a quantity of spherically shaped buoyant bodies 40 having a diameter greater than the diameters of water discharge ports 32. Buoyant bodies 40 are prevented from exiting buoyant body chamber 38 through a water passageway 42 of hose fitting 34 by a screen member 44. As shown in FIG. 2A, screen member 44 is a disk shaped section of screen that is frictionally fit within water passageway 42 and has a mesh size smaller than the diameter of buoyant bodies 40. Although upper and lower housing members 26,28 in this exemplary embodiment have curved inner surfaces 36*a*,36*b*, the inner surfaces 36*a*,36*b* may be planar or a combination. FIG. 3 shows a cross section of sprinkler head 10 along the line II—II of FIG. 2 with buoyant bodies 40 removed from buoyant body chamber 38 to reveal the symmetrically spaced water discharge ports 32. Sprinkler head 10 is symmetrical about its longitudinal axis. FIG. 4 illustrates the sprinkler head 10 of FIG. 2 with the longitudinal axis 48 thereof oriented at an angle "A" with respect to an upwardly oriented reference line "B." In use, sprinkler head 10 is connected to a source of pressurized water. The pressurized water fills buoyant body chamber 38 and causes buoyant bodies 40 to float upwardly toward interior curved surface 36*a* and pressurized water to discharge through the plurality of water discharge ports 32. The discharging water creates a lifting force against sprinkler head 10 causing it to move upwardly in the direction opposite the discharge. Sprinkler head 10 rises until hose member 12 restricts its upward movement. As sprinkler head 10 and buoyant body chamber 38 therein change orientation with respect to reference line "B", buoyant bodies 40 shift within buoyant body chamber 38. Although turbulent water flow within buoyant body chamber 38 causes buoyant bodies 40 to move constantly within buoyant body chamber 38, buoyant forces move a greater number of buoyant bodies 40 into the higher level region of buoyant body chamber 38. As the density of buoyant bodies 40 within the higher region of buoyant body chamber 38 increases, water flow through that region of buoyant body chamber 38 is decreased. Because water flow decreases through the said region, the force of the discharge from the higher level water discharge ports 32 also decreases and changes the balance of all the forces, and the force generated from the region not restricted is sufficient to bring sprinkler head 10 back into operating orientation.

Figure 5:
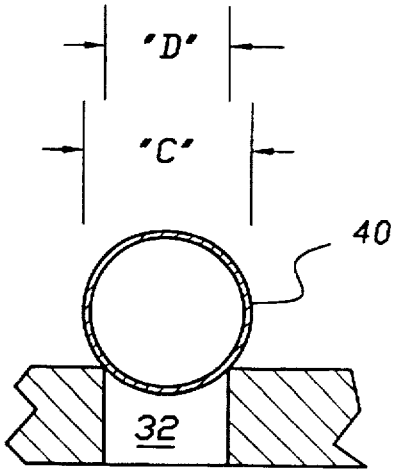
FIG. 5 is a cross sectional detail view of an exemplary buoyant body blocking one of the water discharge ports.

Although the increased density of buoyant bodies 40 within a region provides the primary restriction flow through that region, a second flow restricting mechanism can be achieved through the use of spherical buoyant bodies. As shown in FIG. 5, when spherical buoyant bodies 38 are used, a buoyant body 40 can cover and block a water discharge aperture 32. Of course, the diameter "C" of buoyant body 40 must be greater than the diameter "D" of water discharge aperture 32. Although spherical buoyant bodies 40 are utilized in this embodiment, any buoyant body shape or construction may be used to practice the invention that provides a buoyant body that is sufficiently buoyant in pressurized water.

It can be seen from the preceding description that a self-righting rising sprinkler head has been provided that has a plurality of water discharge ports, that utilizes the force of water discharged through the water discharge ports as a force for lifting and maintaining the sprinkler head above the vegetation surface; and that includes a mechanism for regulating the discharge of water through the plurality of water discharge ports in a manner aimed to maintain the sprinkler head in a lifting orientation. Although flexible hose 12 in this embodiment is six feet long, various lengths of hose can be used by simply increasing the pressure of the pressurized water source used.

It is noted that the embodiment of the self-righting rising sprinkler head described herein in detail for exemplary purposes is of course subject to many different variations in structure, design, application and methodology. This is particularly applicable in the choice of means and methods used to attach the hose to the sprinkler head. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A self-righting rising sprinkler head comprising:

a sprinkler head housing that defines a buoyant body chamber therein;

at least one buoyant body disposed within said buoyant body chamber; and a connecting fitting in connection with said sprinkler head housing adapted for securing said sprinkler head to a source of pressurized water in a manner to supply said buoyant body chamber with pressurized water;

said at least one buoyant body being of sufficient size to decrease water flow through the region in which it is located, said sprinkler head housing including a plurality of water discharge ports, each said water discharge port providing a fluid passageway between said buoyant body chamber and the exterior of said sprinkler head housing;

said water discharge ports being oriented in a manner such that the sum of forces created by water discharging from said water discharge ports creates a lifting force acting against said sprinkler head in a first direction.

2. A self-righting rising sprinkler head comprising:

a sprinkler head housing that defines a buoyant body chamber therein;

at least one buoyant body disposed within said buoyant body chamber; and a connecting fitting in connection with said sprinkler head housing adapted for securing said sprinkler head to a source of pressurized water in a manner to supply said buoyant body chamber with pressurized water;

said at least one buoyant body being of sufficient size to decrease water flow through the region in which it is located, said sprinkler head housing including a plurality of water discharge ports, each said water discharge port providing a fluid passageway between said buoyant body chamber and the exterior of said sprinkler head housing;

said at least one buoyant body being of a size and shape sufficient to prevent passage thereof through said plurality of water discharge ports;

said water discharge ports being oriented in a manner such that the sum of forces created by water discharging from said water discharge ports creates a lifting force acting against said sprinkler head in a first direction.

3. The self-righting rising sprinkler head of claim 2, wherein:

said at least one buoyant body is sufficiently buoyant float in an upward direction when said buoyant body chamber is filled with pressurized water.

* * * * *